US007476155B2

(12) United States Patent
Lind et al.

(10) Patent No.: US 7,476,155 B2
(45) Date of Patent: Jan. 13, 2009

(54) GAMING APPARATUS AND METHOD FOR PROVIDING ENHANCED PLAYER PARTICIPATION IN LOTTERY GAMES

(75) Inventors: Clifton Lind, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 845 days.

(21) Appl. No.: 10/919,209

(22) Filed: Aug. 16, 2004

(65) Prior Publication Data

US 2005/0239552 A1 Oct. 27, 2005

Related U.S. Application Data

(60) Provisional application No. 60/564,789, filed on Apr. 23, 2004.

(51) Int. Cl.
*A63F 9/00* (2006.01)
*A63F 9/24* (2006.01)

(52) U.S. Cl. ..... 463/42; 463/16; 463/43

(58) Field of Classification Search ..... 463/43, 463/16, 42

See application file for complete search history.

(56) References Cited

U.S. PATENT DOCUMENTS

| | | | | |
|---|---|---|---|---|
| 5,788,237 | A | 8/1998 | Fults et al. | |
| 5,871,398 | A | 2/1999 | Schneier et al. | |
| 6,183,361 | B1 | 2/2001 | Cummings et al. | |
| 6,203,011 | B1 | 3/2001 | Nulph | |
| 6,241,606 | B1 | 6/2001 | Riendeau et al. | |
| 6,309,298 | B1 | 10/2001 | Gerow | |
| 6,346,043 | B1 | 2/2002 | Colin et al. | |
| 6,358,151 | B1 * | 3/2002 | Enzminger et al. | 463/43 |
| 6,398,646 | B1 | 6/2002 | Wei et al. | |
| 6,402,614 | B1 | 6/2002 | Schneier et al. | |
| 6,524,184 | B1 | 2/2003 | Lind et al. | |
| 6,602,138 | B2 * | 8/2003 | Nulph | 463/25 |
| 6,645,074 | B2 | 11/2003 | Thomas et al. | |
| 6,645,077 | B2 * | 11/2003 | Rowe | 463/42 |
| 7,156,741 | B2 | 1/2007 | Hornik et al. | |
| 2001/0004609 | A1 | 6/2001 | Walker et al. | |
| 2001/0036855 | A1 | 11/2001 | DeFrees-Parrott et al. | |
| 2002/0094859 | A1 | 7/2002 | Hirsch et al. | |
| 2005/0090305 | A1 | 4/2005 | Silva et al. | |
| 2005/0187014 | A1 | 8/2005 | Saffari et al. | |

* cited by examiner

*Primary Examiner*—Robert E Pezzuto
*Assistant Examiner*—Damon Pierce
(74) *Attorney, Agent, or Firm*—Russell D. Culbertson; The Culbertson Group, P.C.

(57) ABSTRACT

A lottery gaming system utilizes one or more pools of predetermined game play records. In response to a game play request, the gaming system allocates a number or set of game play records. A representation for each allocated game play record is then displayed to the player in some fashion that does not indicate the result of the respective game play record, and the requesting player is allowed to select one or more of the allocated game play records through the respective representations. The selected game play record or records are assigned to the player and the player ultimately sees the result associated with each selected game play record. However, the allocated game play records that are not selected by the player, and thus remain unassigned, are collected or otherwise made available for use in response to another game play request.

12 Claims, 4 Drawing Sheets

GAMING APPARATUS AND METHOD FOR PROVIDING ENHANCED PLAYER PARTICIPATION IN LOTTERY GAMES

CROSS-REFERENCE TO RELATED APPLICATION

The Applicants claim the benefit, under 35 U.S.C. § 119(e), of U.S. Provisional Patent Application No. 60/564,789 filed Apr. 23, 2004 and entitled "GAMING APPARATUS AND METHOD FOR PROVIDING ENHANCED PLAYER PARTICIPATION IN LOTTERY GAMES." The entire content of this provisional application is incorporated herein by this reference.

TECHNICAL FIELD OF THE INVENTION

This invention relates to games of chance, and, more particularly, to electronic lottery games that provide for active player participation. The invention includes a gaming method and a gaming apparatus. The invention also encompasses a program product for implementing the gaming method.

BACKGROUND OF THE INVENTION

Lottery games have become popular in many jurisdictions in the United States and elsewhere. As used in this disclosure, a "lottery game" includes a game that is played with a pool of predefined tickets or game play records that are each associated with a particular result in the game. Some of the predefined tickets or game play records are each associated with a respective winning result and thus represent winning tickets. Other predefined tickets or game play records in the pool are each associated with a respective losing result and thus represent losing tickets or game play records. Since the pool of tickets or game play records has a predefined number of tickets or game play records and a predefined number of winning and losing records, the pool has a predefined payout to players and predefined hold for the game operator. That is, assuming that all tickets or game play records in the pool are sold, the cumulative payout to the players is known as is the cumulative value in from ticket or game play record sales.

Traditional lottery games are played with a paper lottery ticket. These paper lottery tickets are commonly printed with graphics consistent with a theme of the game. The printed graphics for each respective ticket include some result indicator that is correlated to or indicates the result associated with the respective ticket. These result indicators are commonly covered or obscured at the time the ticket is sold. Once the player obtains the ticket, he or she may remove the cover or obscuring material to reveal the result indicator and thus the result associated with the ticket.

The paper tickets in a traditional lottery game are commonly produced at some manufacturing facility in books of tickets, each made up of a continuous roll of individual tickets or a continuous fan fold stack of individual tickets with the individual tickets separated by perforations or break lines. The tickets are randomly ordered in the ticket books or groups and are sold and distributed sequentially from the randomized group of tickets so that the results in the lottery game are distributed to players in a random order unknown to the players or ticket sellers.

Lottery games have been implemented in electronic form in which the tickets or game play records each comprise an electronic data structure rather than a physical paper ticket. An electronic data structure representing a chance in a lottery-type game will be referred to further in this disclosure as a "game play record." These game play records may take on a number of different forms. On one end of the spectrum each game play record includes a result indicator, record identifier, and data that defines graphics that are used to display the result of the game play record to the player. At the other end of the spectrum, each game play record includes only a record identifier, a result indicator, and perhaps a table identifier and prize value. Regardless of the particular form of data structure used for the individual game play records, the game play records are commonly grouped in data files analogous to books of paper tickets and distributed in some random order from the file. Since the game play records are arranged in data files, the random distribution may be performed by randomizing the order of game play records in the respective data file and then distributing the game play records sequentially in that random order, or the game play records can be ordered in the data files and distributed randomly from the files.

The electronic lottery games may be implemented with a gaming system that includes a central processing system for storing a file or different files of game play records and for distributing the game play records to player terminals which are in communication with the central processing system. The player terminals include a display device for displaying information to the player, an arrangement for accepting wagers, and an arrangement for receiving inputs from the player. In this example electronic lottery system, a player enters the lottery game by making a game play request at a player terminal. In response to a game play request entered by the player, the central processing system assigns a particular game play record for the game play request and communicates to the player terminal either the assigned game play record or information regarding the assigned game play record. The player terminal then displays the result associated with the game play record assigned to the player.

Game designers have sought to add excitement to lottery games. One particular method of adding excitement to a lottery game is to give the player the ability to choose from a number of game play records or chances from the pool of records or chances. Traditional paper lottery games have done this by using tickets having multiple chances or result indicators which are initially obscured and allowing the player to select one or more of the chances/result indicators. In this arrangement, each different chance may represent a different game play record, and the player essentially chooses his or her game play record from the group printed on the ticket. U.S. Pat. No. 5,871,398 to Schneier, et al. discloses an electronically implemented system in which players make a selection from among a number of game play outcomes with each outcome representing a distinct chance in the game. In both of these prior art lottery game implementations, the results associated with game play records or the outcomes that are not selected by the player are not available for reuse. Thus, at least some of the game play records or outcomes making up the predetermined pool of records or outcomes are never used in these prior art systems and are essentially wasted.

U.S. Pat. No. 6,241,606 to Riendeau, et al. discloses a lottery-type gaming system in which files of electronic game play records are downloaded to a particular gaming terminal for use in satisfying game play requests. At the end of some gaming period, game play records remaining unused at the gaming terminal are communicated back to a central processing system and collected with other unused game play records and undistributed game play records. These collected game play records are then used to make files of game play records that are downloaded to gaming terminals for use in satisfying later game play requests. U.S. Pat. No. 6,241,606 did not, however, disclose any arrangement for reusing game play records remaining unselected after being assigned to a game play request initiated by a player.

SUMMARY OF THE INVENTION

The present invention provides a method for electronically implemented lottery games that allows players to select from among different game play records and recovers or collects the unselected game play records for use in response to a future game play request. The present invention also encompasses apparatus and program products for implementing this gaming method.

A lottery gaming system according to the present invention utilizes one or more pools of predetermined game play records similar to the game play record pools used in earlier systems. In response to a game play request, the present gaming system allocates a number or set of game play records. A representation for each allocated game play record is then displayed to the player in some fashion that does not indicate the result of the respective game play record, and the requesting player is allowed to select one or more of the allocated game play records through the respective representations. The selected game play records are assigned to the player and the player ultimately sees the result associated with each selected game play record. However, the allocated game play records that are not selected by the player, and thus remain unassigned, are collected or otherwise made available for use in response to another game play request.

The invention encompasses a variety of processes for making the unassigned game play records, that is, records that have been allocated for a game play record set but have not been assigned to a particular player, available for reuse in response to a later game play request. In one preferred process for making unassigned game play records available for use to satisfy a later game play request, each game play record in a game play record file includes or is associated with a status field that may be used to mark a status for the game play record. This status field for each game play record is originally marked as "valid," meaning that the game play record is available for allocation or assignment in response to a game play request. At the time a respective game play request is allocated to a game play record set in response to a game play request, the status field for that game play record is marked "invalid" or "used." This status indicates that the game play record is not available for allocation or assignment in response to a game play request. Once the player makes his or her selection of one or more game play records from the allocated game play record set, the selected game play record or records retain the "invalid" status, while the unselected game play records, that is, the unassigned game play records, are changed back to "valid" status. These "valid" unassigned game play records are again available for allocation or assignment in response to another game play request.

In another form of the invention, the unassigned records from each game play record set are collected to form a separate unassigned or collected record file. Once the unassigned record file contains a certain minimum number of game play records, the game play records are assigned or allocated to satisfy subsequent game play requests. Alternatively, the unassigned records are returned to the file that they were drawn from originally and either added to the end of the file in the order they were initially drawn or reshuffled and then placed at the end of the file. Another method for collecting game play records within the scope of the present invention includes adding the unassigned game play records to another game play record file other than the file from which the unassigned game play records were originally drawn.

In one preferred form of the invention, the game play record files are held at a central processing system that services game play requests from a number of player terminals. In this form of the invention, game play record sets are assembled at the central processing system for allocation to the individual player terminals by randomly assigning game play records from one or more files of game play records to each game play record set. This randomization may be accomplished by assigning game play records sequentially from a previously randomized file of records or by assigning game play records in a random fashion from one or more randomized or unrandomized files of game play records. Regardless of how the randomization is accomplished, the central processing system represents a game play record allocation arrangement for allocating game play records to the game play record sets. A gaming system or apparatus according to the invention further includes a record assignment arrangement for assigning game play records from the allocated set of records in response to a player choice input and a record collection arrangement for making the unassigned game play records available to satisfy another game play request. These arrangements may be implemented in the central processing system or player terminal within the scope of the invention.

It should be noted that the collected, unassigned game play records do not have to be used in a later game play record set. For example, the unassigned game play records may be collected for use in a lottery game where an individual game play record is assigned to a player in response to a game play request and the player does not have a choice amongst different game play records. In addition, each of the game play records in a set need not come from the same game play record file. For example, the game play records in a given set allocated for a game play request may be drawn from different files of game play records.

The method according to the invention is preferably implemented using operational computer program code. This program code may include record allocation program code and record collection program code. The record collection program code makes the unassigned game play records from various sets of game play records that have already been allocated in response to game play requests available for use in satisfying a later game play request. The record allocation program code allocates game play records in response to game play requests. This allocation may include either game play records that have never been previously allocated or previously allocated but unassigned game play records. In the preferred form of the invention the record assignment program code assigns one or more game play records from the allocated game play record set to a player in response to a player choice input initiated by the player.

The present invention adds excitement to game play by allowing the player to select the game play record or records that will be used to satisfy their game play request. This gives the player the perception that their skill affects the outcome of the game. However, the game play records remain randomly assigned, with the player's selection only adding to the randomization. Also, the added player excitement is produced without wasting game play records. Since all or substantially all of the game play records in a pool of records may be used according to the invention, the payout and hold from the pool remains essentially predetermined and is not substantially affected by the players' selections.

These and other advantages and features of the invention will be apparent from the following description of the preferred embodiments, considered along with the accompanying drawings.

DESCRIPTION OF PREFERRED EMBODIMENTS

The present invention will be described below with reference to a particular implementation using a particular arrangement of hardware and data structures. This implementation includes a hardware arrangement similar to that described in U.S. Pat. No. 6,524,184 issued on Feb. 25, 2003. The entire content of U.S. Pat. No. 6,524,184 is hereby incorporated herein by this reference. However, it will be appreciated that the present invention is by no means limited to this particular arrangement of hardware, the methods implemented in the hardware, or the example data structures described below. Numerous variations on this implementation are possible within the scope of the present invention.

Figure 1:
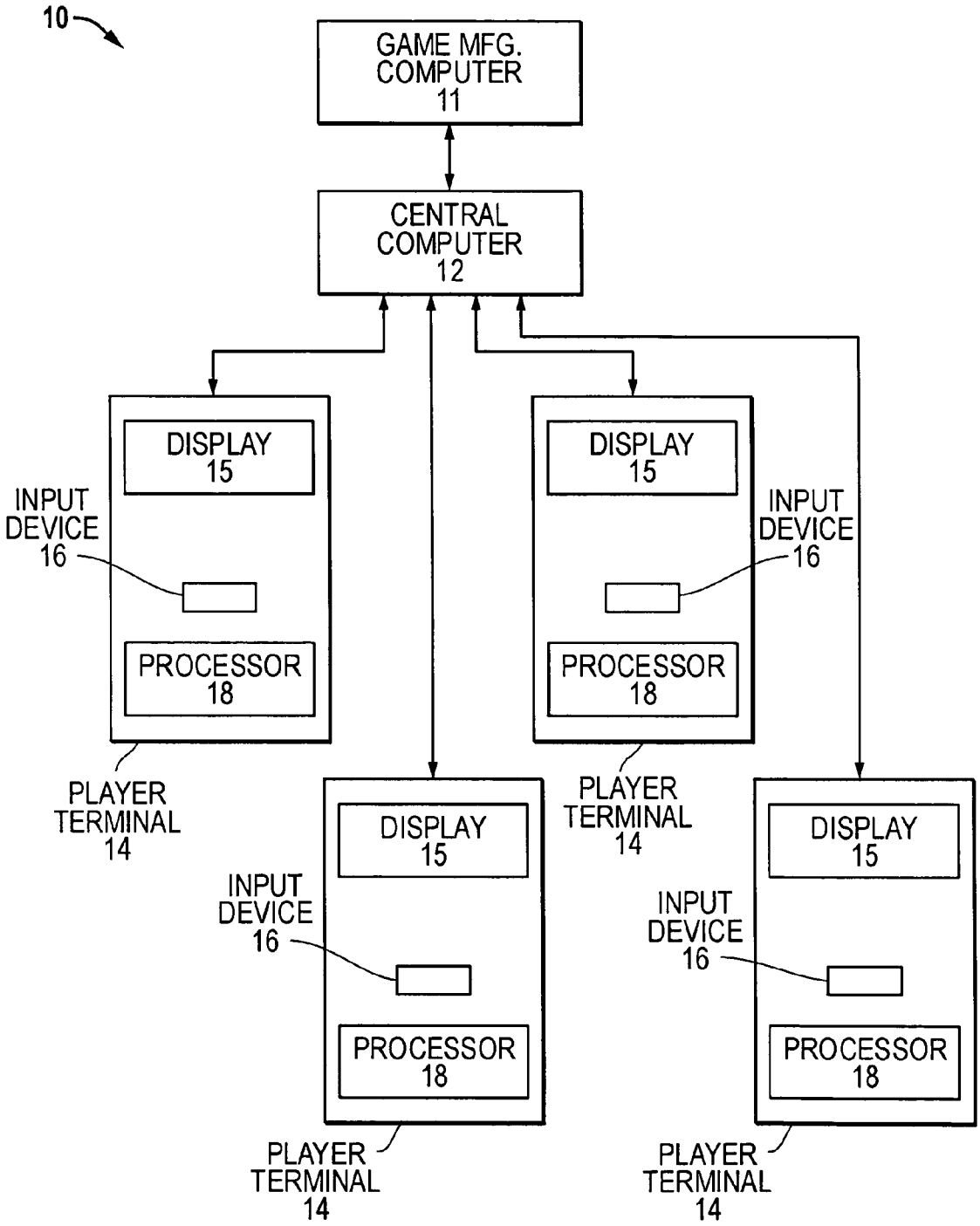
FIG. 1 is a diagrammatic representation of a gaming apparatus embodying one preferred form of the invention.

Referring now to FIG. 1, a gaming apparatus 10 embodying the principles of the invention includes a game manufacturing computer or system 11, a central computer or system 12 in communication with game manufacturing system 11, and a number of player terminals or player stations 14 each in communication with central system 12. In this particular embodiment, pools of game play records are created at game manufacturing system 11 and then stored in a storage device, such as a hard drive (not shown separately), that is associated with the game manufacturing system. The pools of game play records are transferred periodically to central system 12. Game play records are then allocated or assigned from central system 12 in response to game play requests from player terminals 14. In one preferred form of the invention, manufacturing system 11 produces very large pools of game play records according to a particular game payout, hold, and win distribution design, and then divides each pool into a number of randomized game record subsets which preferably do not include any predetermined number of winning or losing game play records or any particular winning or losing game play record distribution. These subsets of game records are then transferred to central system 12 in order to ensure a supply of game play records at the central system sufficient to satisfy the game play requests incoming from the various player terminals 14.

Each player terminal 14 includes a display 15 for displaying various game representations, and further includes an input device 16 for receiving player inputs, including game play requests. The input device may include any type of input arrangement including one or more push buttons, keys, or lever activated switches. Also, the input device 16 may include a touch screen and thus be integrated with display 15. Although not shown in the drawings, each player terminal 14 may also include an arrangement for receiving payments from a player and an arrangement for making payouts to the player. Payouts may be made using a coin or token dispensing arrangement (not shown) included in player terminal 14. Alternatively, or in addition to a coin or token dispensing arrangement, player terminal 14 may include a printer (not shown) for printing a ticket or voucher showing the player's winnings or account value. The player may redeem this ticket through a game operator, for example, or use the ticket in another gaming terminal. In yet other arrangements, wagers and winnings may be tracked through a suitable player account arrangement included in system 10, and a player may redeem their account through a system cashier or through some other suitable account interface arrangement.

The player terminals 14 shown in FIG. 1 also each include a processor 18 for executing game control software which implements the gaming method and drives or communicates with the various other devices included in the respective player terminal. Other forms of the invention may perform some or all of this game play processing at a central computer system such as system 12. The invention is not limited to any particular processing arrangement.

Methods of producing pools of game play records for a lottery-type game are well known in the art and will not be discussed in detail here so as not to obscure the invention in unnecessary detail. In every lottery-type game, it will be appreciated that the game play records are ultimately assigned to players randomly. This randomization may be accomplished generally in one of two ways. One method for ensuring game play records are assigned randomly is to randomize the order of game play records in the pool or pool subsets and then assign game play records sequentially from the randomized game play records. The second common method for ensuring game play records are assigned in random order is to randomly assign game play records from an ordered or unrandomized pool or subset of game play records. Further details on one preferred structure of the game play records pools or pool subsets and a preferred structure of the game play records themselves will be described below with reference to FIG. 2.

Those skilled in the art will appreciate that the invention may be embodied in many arrangements other than the illustrative arrangement shown in FIG. 1. For example, a single computer system may generate the game play records according to the invention and may also store the game play records for distribution to several player terminals such as terminals 14. Pools or pool subsets of game play records may also be stored at a respective player terminal for use in satisfying game play requests according to the invention. Furthermore, it will be appreciated that although four player terminals 14 are shown in FIG. 1 for purposes of illustrating the invention, any number of player terminals may be included in an apparatus embodying the principles of the invention. In yet other arrangements within the scope of the present invention, a single computer system could perform the game play record generation function, the game play record storage function, and player interaction function, thus replacing the separate systems 11, 12, and 14 shown in FIG. 1. These alternative arrangements are to be considered equivalent to the arrangement shown in FIG. 1. Furthermore, there may be wide variation within the scope of the present invention in the specific components included even in the basic arrangement of systems shown in FIG. 1. For example, central computer system 12 may in fact be made up of several different processing systems rather than a single computer. In one preferred form of the invention, central system 12 includes a separate processing device programmed to receive and respond to game play requests and a separate processing device programmed to implement databases for supporting the operation of the processing device for servicing game play requests.

Central system 12 may include a monitoring arrangement for monitoring the number of unassigned game play records available at the central system. When the number of unassigned game play records reaches some minimum value, the monitoring arrangement may cause the central system 12 to make a request to game manufacturing system 11 to send additional game play records.

Figure 2:
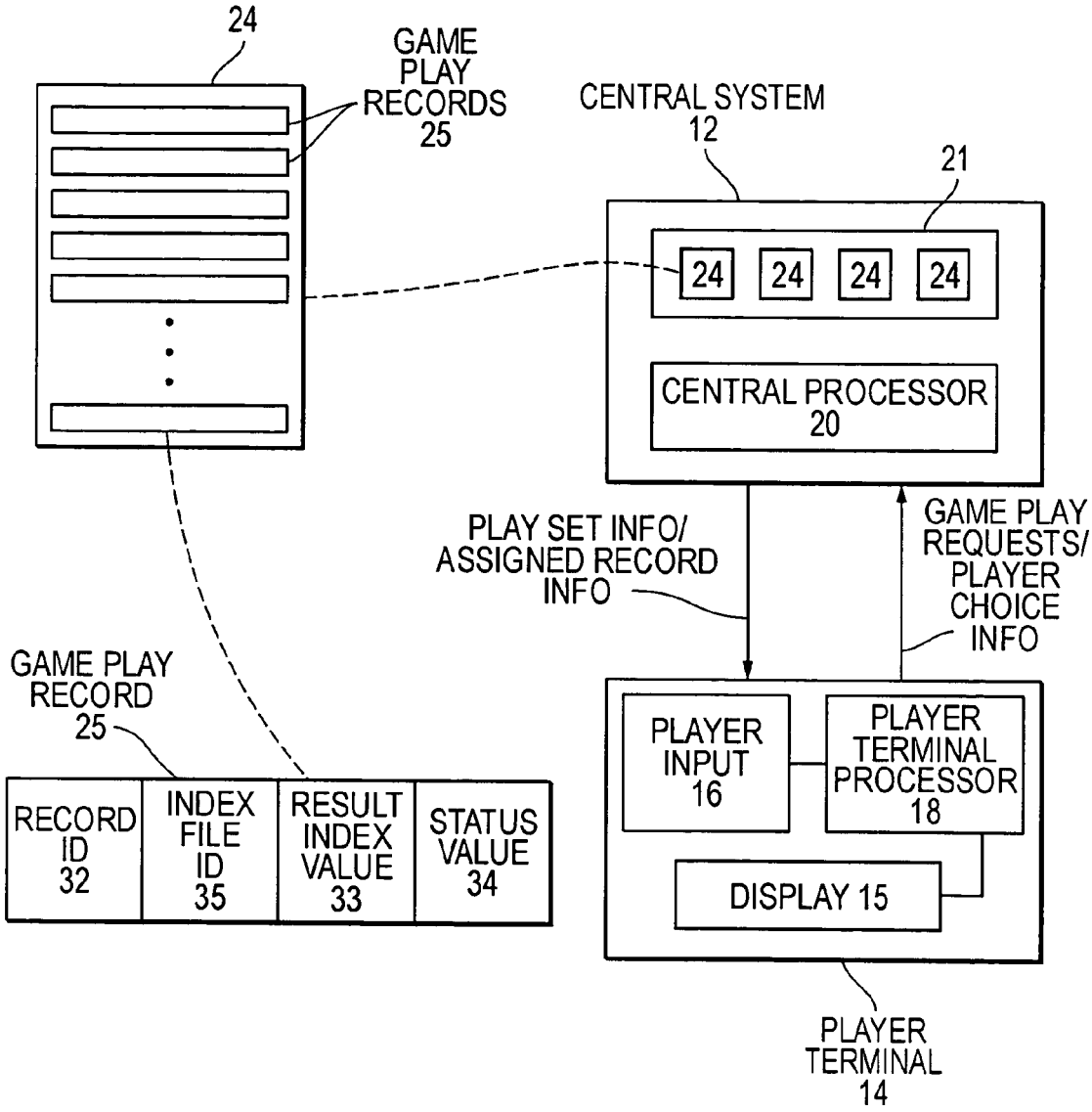
FIG. 2 is a diagrammatic representation of the central processing system and a single player terminal as shown in FIG. 1, along with data structures employed in one preferred form of the invention.

Referring to FIG. 2, central system 12 includes a central processor 20 and a game play record file storage device 21. Those skilled in the art will appreciate that random access memory and other components will be associated with central processor 20 even though these additional components are omitted from the drawing so as not to obscure the invention in unnecessary detail. Central processor 20 executes program code to perform certain method steps described below with reference to FIG. 3. In one preferred form of the invention, central processor 20 in central system 12 executes program code to implement the allocation of game play records to game play record sets, the assignment of at least one game play record from the set in response to a player choice input, and the making of unassigned game play records available for use in satisfying a future game play request. In this preferred form of the invention, central system 12 represents a record allocation arrangement, a record assignment arrangement, and a record collection arrangement. However, it will be appreciated that other preferred forms of the invention may distribute the record allocation, assignment, and collection functions differently and thus one or more other components in a system according to the present invention may represent the record allocation, assignment, and collection arrangements.

Each player terminal 14 is connected for communication with central system 12 so that information may be communicated from the player terminal to the central system and so that information may be communicated from the central system to the player terminal. The specific types of communications required in a system according to the invention will vary from implementation to implementation. However, the communication arrangement at least supports the communication of game play requests and player game play record selection information from the respective player terminal 14 to central system 12, and the communication of assigned game play record information from the central system to the respective player terminal. Specific examples of communications between a player terminal 14 and central system 12 will be described below with reference to FIG. 3.

In the preferred form of the invention illustrated in FIG. 2, storage device 21 at central system 12 stores a number of game play record files 24 that have been obtained preferably from the game manufacturing system 11 shown in FIG. 1, or from some other suitable source. Each game play record file 24 includes a number of separate game play records 25. Each game play record file 24 may also include header information regarding the contents and source of the respective file and allowing each respective file to be identified and addressed. As mentioned previously, in preferred forms of the invention each file 24 comprises a subset of game play records from a larger pool of game play records. A preferred game play record structure includes the record identifier 32, a result index value 33, a status value 34, and an index file identifier 35. The order in which these elements are shown in FIG. 2 is shown only for purposes of example, and any other order may be used within the scope of the invention. Also, the manner in which these values or identifiers are included in each game play record 25 is subject to wide variation within the scope of the invention. In one form of the invention for example, the identifiers or values are simply arranged in comma delimited fields in each game play record.

Record identifier 32 is preferably unique to each game play record 25 in the respective file 24 so that the record may be addressed in the respective file by the identifier. Alternative forms of the invention may include a sequence value (not shown) in each game play record 25 as a substitute or alternative means for addressing a respective game play record. Result index value 33 is the element from record 25 that represents the particular result of the game play record in the preferred form of the invention. Each possible result index value 33 is correlated to a result in the game and thus indicates whether a particular game play record is associated with a predetermined winning or losing outcome and the corresponding prize amount, if applicable. Alternative forms of the invention may include an actual result value in the respective game play record, rather than using the result index value 33 to identify the result value or in addition to using the result index value. Status value 34 is included in the illustrated form of the invention to indicate the status of the respective game play record as "valid" or "invalid." These designations valid and invalid or some other suitable designations are used in one preferred form of the invention to indicate whether the particular game play record is available to be allocated to a game play record set or is not available. In one preferred form of the invention, the status value comprises a single bit. Index file identifier 35 is included in the illustrated form of the invention to identify a particular result index file to which the respective result index value belongs. In forms of the invention using a result index value and an index file value, both of these values are used to identify the particular result associated with the game play record.

It will be appreciated that numerous different data structures may be used for game play records within the scope of the invention. The particular game play record structure shown in FIG. 2 follows a philosophy of including a minimum amount of data in each game play record. Alternative forms of the invention may utilize game play records that include additional data, such as data necessary to produce graphics to represent the result of the game play record to the player at player terminal 14. Also, it will be appreciated that status information regarding each game play record need not be maintained in the respective game play records itself. Rather, a separate file or data table may be used to maintain status information for each game play record in a game play record file.

Player terminal processor 18 may execute computer program code to allow a player to make game play requests and to produce graphic display commands to cause display 15 to produce suitable displays in response to game play record set information from central system 12 and assigned game play record information from the central system. Display 15 may be used to produce any number of game presentations under the control of the display driving or controlling program code. In particular, it should be noted that a gaming system such as that illustrated in FIGS. 1 and 2 according to the present invention may include player terminals 14 that provide many different types of game presentations. The different game presentations may require presentation-specific game play records. Alternatively, a single game play record file 24 may be used in some forms of the invention to satisfy game play requests from player terminals 14 implementing different game presentations. Game presentations that may be used with the present invention include presentations that mimic paper lottery games, card games such as poker or black jack, reel-type games (slot machines), contests such as horse or dog races, or any other type of game. Where the graphic representation includes a representation of a scratch-off ticket, for example, the information required to produce a graphic representation may include a file or object to generate the basic ticket graphic, and files or objects to draw any symbols which may appear on the ticket. It will be appreciated that the data storage arrangement (arrangement of random access memory, read only memory, and hard drives, for example), associated with player terminal processor 18 has the ability to store all the information required to produce such a graphic representation.

Player input device 16 may include any suitable arrangement to allow the player to make game play requests. Regardless of the specific hardware arrangement used to allow a player to initiate a game play request (buttons, switches, cursor controller/display combination, or touch screen display, for example), the player terminal processor 18 preferably responds to a game play request input from the player by generating a game play request that includes sufficient information to allow the central system 12 to respond appropriately. For example, the game play request may include a game play record file type identifier that identifies the type of game play record file 24 that must be used to satisfy the game play request. Central computer system 12 may then use this game play record file type identifier to identify a particular game play record file 24 that will supply game play records 25 to satisfy the game play request. The game play request will also generally include some identifier indicating which player terminal 14 is originating the request, and perhaps other information.

FIG. 2 also shows several different game play record files 24 stored at storage device 21. This reflects the fact that multiple lottery-type games may be in play at any given time in the present system, with each game having its own game play record file 24. Even with one game in play, two or more different game play record files 24 may be used alternately or in combination in accessing game play records 25. Where multiple game play record files are used, central processor 20 is able to distinguish between files and choose the correct file or files in response to a game play request from player terminal 14 using information included or associated with the game play request.

Figure 3:
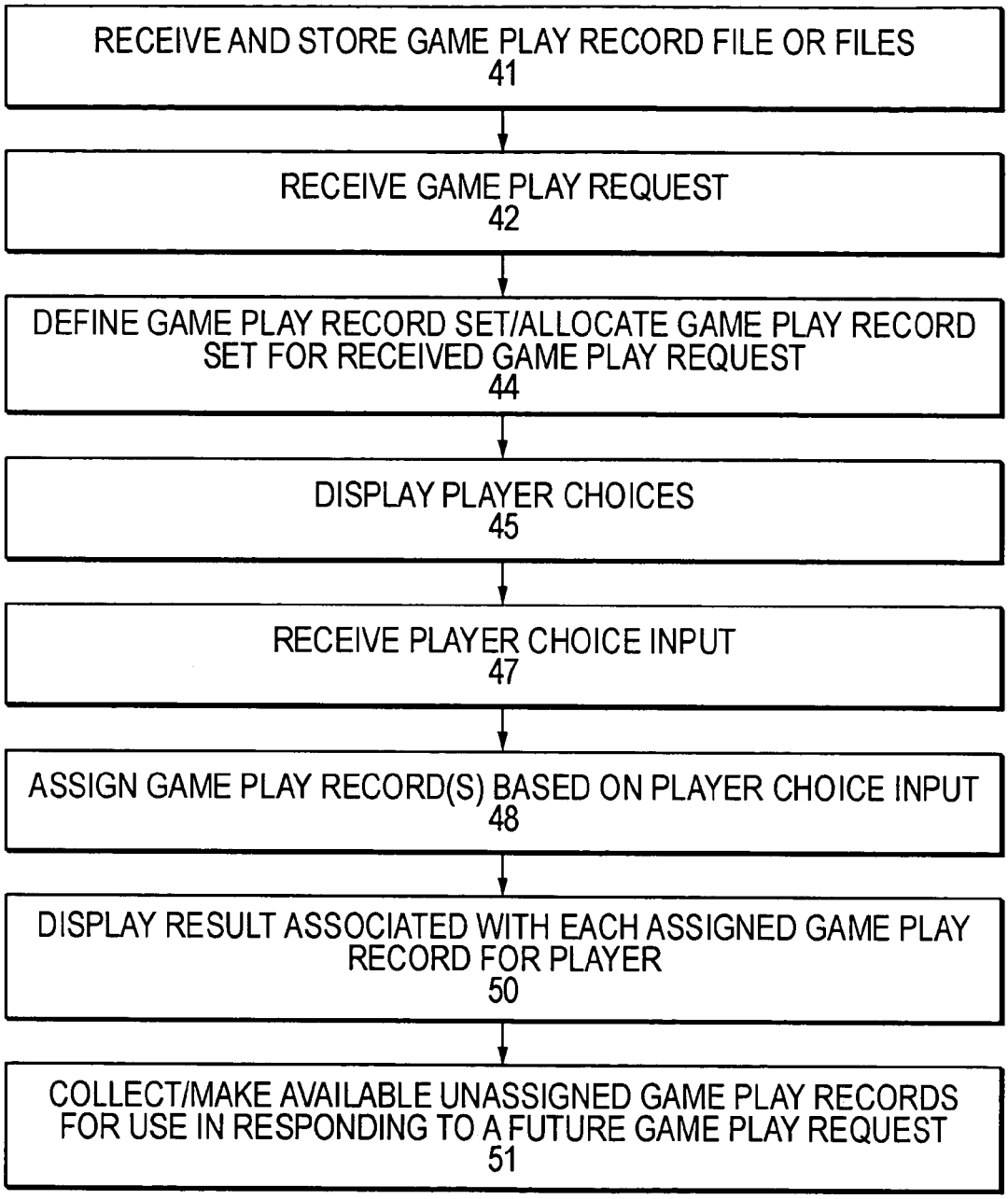
FIG. 3 is a flow chart illustrating a gaming method embodying the principles of the invention.

FIG. 3 may be used to describe an overall method embodying the present invention together with variations within the scope of the invention regarding making unassigned game play records available for use in responding to a subsequent game play request. It will be appreciated that the references to system components in the following discussion of FIG. 3 are references to the system components shown in FIGS. 1 and 2. These system components are not illustrated in FIG. 3.

As shown in FIG. 3 a method according to the invention includes receiving and storing one or more game play record files at a suitable storage device as indicated at process block 41. In the form of the invention illustrated in FIGS. 1 and 2, central system 12 and specifically storage device 21 at the central system receives and stores one or more game play record files 24. The storage of game play record files as shown in process block 41 in FIG. 3 is preferably performed under the control of game play record file storage program code executed by a suitable processing device such as central processor 20. As discussed above, a monitoring arrangement implemented through suitable game play record file monitoring program code may monitor the game play record files 24 and submit requests for additional game play record files as necessary to ensure a sufficient number of game play records are maintained in storage for satisfying incoming game play requests.

As shown at process block 42 in FIG. 3 a method according to the invention also includes receiving a game play request. In the form of the invention shown in FIGS. 1 and 2, the game play request is received in a communication from a player terminal 14. A preferred game play request is generated by the player terminal processor 18 under the control of suitable operational program code, and may include a player terminal identifier and a game play record file type identifier that identifies the particular type of game play record file containing game play records that may be used to satisfy the game play record request.

Regardless of the specific form of game play request used in a particular implementation, the invention includes defining a game play record set and allocating the defined game play record set, both preferably in response to the received game play request. This step is shown at process block 44 in FIG. 3. In preferred forms of the invention, the step of defining a game play record set and allocating the game play record set is performed under the control of suitable operational program code executed by a processor associated with the storage device at which the game play record file or files are stored. A preferred program code arrangement includes game play record allocation program code. The particular step or steps performed at process block 44 will depend primarily upon the manner in which unassigned game play records are collected in the particular implementation of the invention as will be described further below with reference to process block 50. For example, the game play record set definition and allocation steps may include changing the status value 34 for each game play record included in the particular game play record set to a status that indicates the respective game play record is invalid, that is, unavailable for further allocation or assignment to satisfy a game play request. Alternative implementations may not include any status value associated with each game play record and the game play record set definition and allocation steps shown at process block 44 may simply include collecting some number of unassigned game play records randomly from the particular game play record file or files being used to satisfy the received game play request. In this alternative, game play records in a game play record file may be arranged in a random sequence and the next predefined number of game play records from the sequence may be selected to define a game play record set which is allocated according to the step shown in process block 44.

It should be noted that a set of game play records for use in satisfying a game play request according to the present invention may be predefined before the receipt or initiation of a game play request. For example, a file of game play records may include predefined groups of game play records that will each be used as a game play record set to satisfy an incoming game play request. In these forms of the invention, only the allocation of the game play record set is performed in response to the incoming game play request.

As shown at process block 45 in FIG. 3, a method according to the invention further includes displaying choices to the player by or through which the player may choose one or perhaps more of the game play records included in the game play record set defined and allocated according to process block 44. For example, player terminal processor 18 may generate graphic instructions for a display which causes display 15 associated with player terminal 14 to produce a graphic of some number of representations equal to the number of game play records included in the defined and allocated game play record set. In one presentation within the scope of the invention for example, the graphic may comprise a number of objects such as stuffed animals equal in number to the number of game play records included in the game play record set defined and allocated as indicated at block 44. As another example, the graphic may be of a number of doors equal to the number of game play records included in the game play record set defined and allocated according to block 44. In any event, the purpose of the player choice display at process block 45 is to allow the player to operate suitable player terminal controls or input devices to produce a player choice input selecting one or perhaps more of the representations and thereby effectively selecting the game play record or records to be assigned to the player. In preferred forms of the invention, the various representations that represent choices or options that may be selected by the player each correspond to a respective game play record in the defined and allocated game play record set. However, it should be noted that the correspondence or correlation between choices displayed to the player at process block 45 and the game play records in the game play record set defined according to process block 44 need not be defined at the time the player choice display is produced. Rather, the correspondence or mapping between player choices and game play records in the game play record set may be performed before or after the player choices are displayed to the player.

Once the player choices are displayed to the player, the player may operate a suitable input device such as device arrangement 16 at player terminal 14 to produce an input that effectively selects one or perhaps more of the available choices. As shown at process block 47 in FIG. 3, the invention includes receiving the player choice input, such as at processor 18 at the respective player terminal 14. In some preferred forms of the invention, the player choice input results in the creation of a suitable packet or collection of data that is communicated back to the processing arrangement controlling the game play record file. In response to the player choice input communication resulting from the player choice input, the invention includes the step of assigning a particular one of the game play records from the game play record set as shown at process block 48 in FIG. 3. In preferred forms of the invention, the particular game play record is assigned from the set based on the player choice input. However, it will be appreciated that forms of the invention may simply use the player choice input as appropriately communicated to randomly select one of the game play records from the allocated game play record set. In this random game play record selection arrangement there is no correspondence between any particular game play record from the game play record set defined at process block 44 and the player choices displayed at process block 45.

Once the particular game play record or records from the game play record set are assigned as indicated at process block 48 in FIG. 3, the method includes displaying the result associated with the assigned game play record to the player. In the implementation of the invention shown in FIGS. 1 and 2, central system 12 may perform the assignment step shown at process block 48 and then communicate the assigned game play record or information associated with the assigned game play record to the respective player terminal 14 so that the player terminal may display the result as indicated at process block 50. In one preferred form of the invention, central system 12 communicates only the result index value 33 to the player terminal 14, and the player terminal processor 18 uses this result index value to produce a suitable graphic to display the result associated with the assigned game play record or records to the player. In this example arrangement, player terminal 14 may store a result index table and performs a table lookup using the result index value to find information about the result so that the result may be appropriately displayed to the player in accordance with the game presentation available at the player terminal.

It will be appreciated that preferred forms of the invention perform the steps described at process blocks 41 through 50 in FIG. 3 in a way that minimizes the amount of communications or data that must be transferred back and forth between central system 12 and player terminal 14. For example, the game play record set definition and allocation steps shown at 44 may not be associated with any step of actually communicating information regarding the defined and allocated game play records to the player terminal at that point. In this example, information on only each game play record actually assigned to the player must be transferred to player terminal 14 in order to allow the player terminal to display the result of the game play according to the step shown at process block 50 in FIG. 3. However, alternate forms of the invention may include transferring data to player terminal 14 regarding each game play record in the defined and allocated game play record set. In this alternative, the step of assigning a particular game play record from the set as shown at process block 48 may be performed at the player terminal 14.

As indicated at process block 51 in FIG. 3, a method according to the present invention includes collecting or otherwise making unassigned game records available for reuse to satisfy later game play requests. Making unassigned game play records available for use is preferably performed under the control of record collection program code executed at central system 12 and/or player terminal 14. The invention encompasses a number of different processes for making unassigned game play records available for use in responding to a subsequent game play request. In one preferred form of the invention, unassigned game play records, that is, the game play records that are not selected from the game play record set and assigned to the particular player as shown at process block 48, are collected back in the original game play record file which originally contained the game play records. This type of unassigned game play record collection may be accomplished using the status value 34 shown in FIG. 2. The process would include changing the status value to "invalid" or to some other indicator at the time the respective game play record is included in a game play record set, thereby indicating that the particular game play record is unavailable for inclusion in another game play record set and unavailable for assignment to another player. Once the particular game play record or records from the set are assigned as indicated at process block 48 in FIG. 3, all of the unassigned game play records from the set may have their status value 34 changed back to valid or some other value to indicate that the particular game play record is available for use either for allocation to another game play record set or for assignment to a particular player. The game play record allocation process may then include querying the game play record file to locate the first valid game play records in the file sequence and allocating those records to the game play record set for responding to the next game play request. It will be noted that this preferred arrangement may not change the sequence of game play records in the game play record files.

Another arrangement for making unassigned game play records available for use from the original game play record file includes returning the unassigned game play records from a game play record set back to the respective game play record file but in a different order. For example, unassigned game play records from a game play record set may be appended randomly or in the original order at the end of the game play record file from which the game play records were allocated.

It will also be appreciated that an unassigned game play record may be appended to a game play record file different from the game play record file that originally included the respective game play record.

An alternate process for making unassigned game play records available for use in responding to a subsequent game play request as indicated at process block 51 in FIG. 3 includes collecting the unassigned game play records from previously allocated game play record sets to make a new game play record file. Unassigned game play records may be collected in a new game play record file until the new file contains sufficient records or some minimum number of records, at which time the new game play record file may be made available for satisfying incoming game play requests. In yet other forms of the invention unassigned game play records may be collected in a file until sufficient records have been collected to create multiple new game play record files. In any case any new game play record files created from collected, unassigned game play records may be used to satisfy game play requests in the original game for which the game play records were intended or for a different type of game such as a bonus type game that may be available to the player through the various player terminals 14. Also, the invention is not limited to collecting unassigned game play records for one or more new files at any particular location in the gaming system. For example, all of the collection of unassigned game play records may be performed at central system 12. Alternatively, all of the collection of unassigned game play records may be performed at each respective player terminal 14. In other forms of the invention, player terminals 14 may be responsible for collecting unassigned game play records and then periodically communicating groups of the assigned game play records back to central system 12. In yet other arrangements a separate processing device included in the system may be responsible for collecting unassigned game play records.

Various combinations of making unassigned game play records available for use and allocating game play records for game play record sets may be used in some preferred forms of the invention. For example, unassigned game play records may be collected in one or more separate unassigned game play record files, and the game play record set allocation process may include allocating to a common game play record set both game play records from an original file of game play records and from a file of collected, unassigned game play records.

It will be appreciated that in preferred forms of the invention the player's choice or selection from the display produced at process block 45 in FIG. 3 actually effects the result for the player's game play requests. That is, the player's choice selected from the display is used in some fashion to select one or more of the game play records from the defined and allocated game play record set and the selected game play records provide the results for the player's play in the game. However, the player choice display produced as indicated at process block 45 does not allow the player to know the result that may be associated with each particular choice. The player choice display may provide information indicating that certain prizes are available from among the different choices but the player terminal will not indicate which choice is associated with which particular result.

Figure 4:
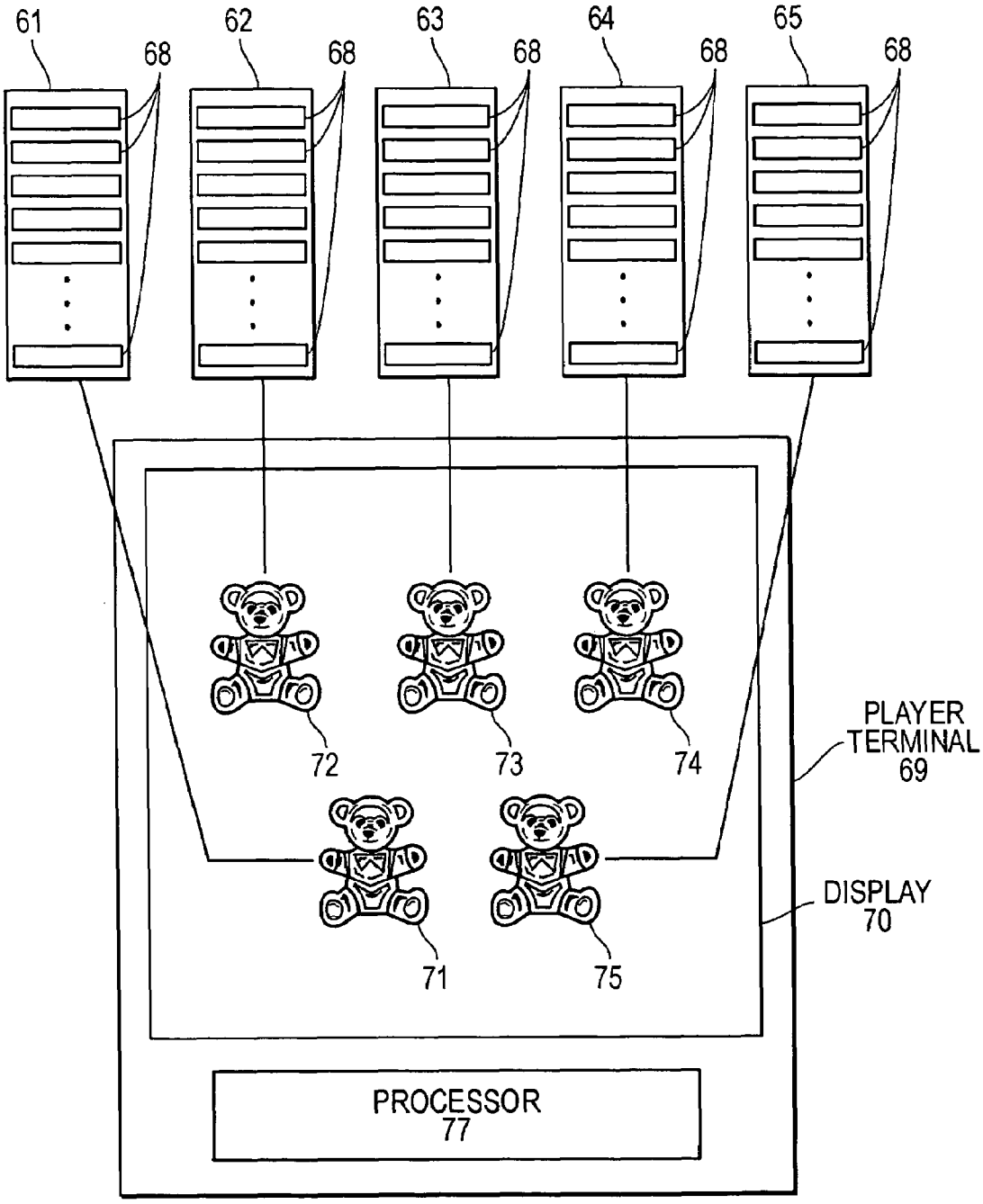
FIG. 4 is a diagrammatic representation of an alternative form of the invention in which multiple game play record files are used to effect the players' choices.

Another alternate embodiment of the present invention employs a number of different game play record pools simultaneously to satisfy game play requests and offer the player the ability to select a game play record from a number of different alternatives. The number of game play record pools employed in this form of the invention is at least equal to the number of choices the player is offered. For example, FIG. 4 diagrammatically illustrates five different game play record pools 61, 62, 63, 64, and 65, each containing a number of individual game play records indicated at reference numeral 68. In response to a game play request entered from a player station 69, the display 70 associated with the player terminal displays five different representations 71, 72, 73, 74, and 75 under the control of player terminal processor 77. Each representation is associated with the next available game play record in one of the game play record pools 61-65. When the player selects one of the representations 71-75, the gaming system selects the next available game play record from the game play record pool with which that representation is associated and that game play record is used to satisfy the player's game play request.

It will be noted that this form of the invention does not require that a game play record 68 from each game play record pool 61-65 be allocated, that is, reserved for potential use in satisfying the game play request. Rather, the next unused or available game play record in each pool 61-65 remains available for use in satisfying any game play request entered from a player terminal in the system. In fact, the arrangement shown in FIG. 4 may be implemented so that the second input by the player, that is, the input selecting one of the representations 61-65 comprises the game play request. The earlier input from the player to display the representations 71-75 may be considered merely a precursor to the game play request. However, even though game play records from the various pools need not be allocated or reserved, the player's choice of representations 71-75 does in fact effect the result of the play for the player given that the results associated with the next available game play record in the pools 61-65 are likely dissimilar. Of course, even in this form of the invention, a game play record from the different pools may be allocated for use in satisfying the game play request, and then unallocated if it is not selected by the player similarly to the previously described embodiments.

A number of variations are possible in this multiple game play record pool form of the present invention. For example, it may be desirable to indicate to the player the results of the unselected alternatives represented by representations 71-75. This may be accomplished by actually allocating the next available game play record 68 in each pool 61-65 at the time the player makes their initial input. This allocation reserves the various game play records so that a certain result for each record may be communicated to the player to show what they would have won had they selected the respective representation. An alternative to allocation of a respective game record 68 from each pool 61-65 comprises reading the result from the next available game record in each pool 61-65 at the time the game record from the selected pool is read. This has the effect of recording the result for each game record that would have been assigned to the player had the player made a different selection. The recorded game play record results may then be displayed to the player to show them what they would have won had they made a different selection. Also, it will be appreciated that there need not be a fixed association between each representation 71-75 and a respective one of the pools 61-65. Rather, a selection of a given representation 71-75 at the player terminal may result in the selection of any one of the pools 61-65 for use in satisfying the game play request. Also, it is possible within the scope of the present invention that one or more of the representations 71-75 may be associated with only a single pool from among multiple game play record pools. However, the player's selection should still have some impact on which pool is selected and thus which game play record is used to satisfy the game play request so that the player's selection will make a difference in the outcome for that game play.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method including the steps of:

(a) allocating a game play record set in response to a game play request initiated for a first player, the game play record set including two or more game play records and being allocated from at least one game play record file that is available for supplying game play records to satisfy the game play request, wherein allocating the set of game play records includes changing the status of each allocated game play record in the respective game play record file to indicate that each respective allocated game play record is unavailable for use in satisfying an additional game play request;

(b) assigning to the first player one or more of the allocated game play records in response to a player choice input from the first player, the player choice input being distinct from any player input to initiate the game play request, and the one or more game play records assigned to the first player identifying a result for the first player, each allocated game play record other than the one or more allocated game play records assigned to the first player representing an unassigned game play record;

(c) changing the status of each unassigned game play record to indicate that the respective unassigned game play record is available for use in satisfying an additional game play request; and (d) assigning one of the allocated, unassigned game play records to a respective player in response to an input initiated by the respective player.

2. The method of claim 1 wherein the step of assigning to the first player one or more game play records from the game play record set includes assigning multiple game play records.

3. The method of claim 1 wherein the step of allocating the set of game play records includes communicating information associated with each allocated game play record to a player terminal through which the game play request was initiated.

4. The method of claim 1 wherein the step of allocating the set of game play records for the game play request includes allocating one or more game play records from each of two or more different files of game play records.

5. The method of claim 1 further including the step of displaying to the first player a set of representations and wherein the player choice input is generated from the first player's selection of one or more of the representations.

6. The method of claim 5 wherein each representation is mapped to a respective allocated game play record.

7. A gaming system including:

(a) a player input device through which a player may initiate a play in a game and a player choice input which is distinct from a game play request in the game;

(b) a data storage device storing a game play record file including a number of game play records available for satisfying the game play request;

(c) a game play record allocation arrangement for allocating a set of game play records from the number of game play records in response to the game play request, the set of game play records including two or more game play records, wherein the allocating includes changing a respective status indicator in the game play record file for each allocated game play record to indicate that each respective allocated game play record is unavailable for use in satisfying an additional game play request;

(d) a game play record assignment arrangement for assigning one or more of the allocated game play records to the player in response to the player choice input, each allocated game play record other than the one or more allocated game play records assigned to the first player representing an unassigned game play record; and (e) a game play record collection arrangement for making at least one unassigned game play record available for response to a future player input, wherein the game play record collection arrangement makes the at least one unassigned game play record available for response to a future player input by changing the respective status indicator associated with the respective unassigned game play record.

8. The apparatus of claim 7 further including a player choice display for presenting to the player a set of representations and wherein the player choice input represents a selection of one or more of the representations.

9. The apparatus of claim 7 wherein the game play record allocation arrangement and game play record collection arrangement are implemented in a first data processing system and wherein the player input device is included with a player terminal separate from the first data processing system and in communication with the first data processing system across a network communications link.

10. A program product stored on a computer readable medium, the program product including:

(a) record allocation program code for allocating a set of game play records from one or more game play record files in response to a game play request initiated for a first player, wherein the record allocation program code changes a respective status for each respective allocated game play record from a first status to a second status in the respective game play record file from which that game play record was allocated, the second status indicating that the respective game play record is unavailable for allocation or assignment for a later input initiated for a respective player;

(b) record assignment program code for assigning one or more of the allocated game play records to the first player in response to a player choice input initiated by the first player, the player choice input being distinct from any input which initiated the game play request, and the assigning of one or more of the allocated game play records leaving one or more allocated game play records that remain unassigned and represent unassigned game play records; and (c) record collection program code for making each unassigned game play record available to be allocated or assigned in response to an input for a respective player, wherein the record collection program code makes a respective unassigned game play record available for allocation or assignment for a later input initiated for a respective player by changing the status of the respective unassigned game play record from the second status to the first status.

11. The program product of claim 10 wherein the record collection program code makes a respective unassigned game play record available for allocation or assignment for a later input initiated for a player by collecting the respective unassigned game play record in a collection data file separate from the respective game play record file from which the respective unassigned game play record was allocated by the record allocation program code.

12. The program product of claim 10 wherein the record collection program code makes a respective unassigned game play record available for allocation or assignment for a later input initiated for a player by collecting the respective unassigned game play record in the respective game play record file from which the respective unassigned game play record was allocated by the record allocation program code.

* * * * *